United States Patent [19]

Otte et al.

[11] 4,142,193

[45] Feb. 27, 1979

[54] FILM STORAGE AND DEVELOPING CASSETTE

[76] Inventors: Hubert J. Otte, 165 Evelyn Ave.; Gosta Roosman, 98 Merrick St., both of Toronto, Ontario, Canada

[21] Appl. No.: 795,631

[22] Filed: May 10, 1977

[51] Int. Cl.[2] ..... G03D 3/16

[52] U.S. Cl. ..... 354/313; 354/323; 352/78 R; 352/130

[58] Field of Search ..... 354/307, 310, 311, 312, 354/313, 314, 316, 323, 331, 333, 335, 336, 338, 340, 341, 83, 89, 90, 91, 92, 93; 352/72, 78 R, 130

[56] References Cited

U.S. PATENT DOCUMENTS

| | | | |
|---|---|---|---|
| 2,507,238 | 5/1950 | Altschuler et al. | 354/310 |
| 2,656,773 | 10/1953 | Wiebalck | 354/310 |
| 3,383,998 | 5/1968 | Takats | 352/72 UX |
| 3,391,625 | 7/1968 | Jacknau | 354/313 |
| 3,706,439 | 12/1972 | Skinner et al. | 352/78 R |

*Primary Examiner*—L. T. Hix
*Assistant Examiner*—Alan Mathews

[57] ABSTRACT

A film storage and developing cassette comprising a closed elongated flattened box-like structure having top and bottom panels, side walls and end walls defining a generally closed light-proof enclosure, and film storage compartment means within said box-like structure, having generally rounded walls therearound, for storing a coiled length of photographic film, and feed passage means communicating between said storage compartment and the exterior of said box-like structure, for the passage of said film therealong, and film development chamber means within said box-like structure, alongside said film storage compartment means, and return passageway means for feeding of said film back into said box-like structure, said return passageway means communicating with said development chamber means, and normally closed port means adapted to be opened after exposure of said film, for introduction of developer chemicals into said development chamber.

7 Claims, 5 Drawing Figures

FILM STORAGE AND DEVELOPING CASSETTE

The invention relates to a film cassette which performs two functions namely the storing of the unexposed photographic film, and the developing of the exposed film.

BACKGROUND OF THE INVENTION

Conventional photographic film cassettes provide for storage of the unexposed film, and the unexposed film is then wound past a lens opening in a camera where it is exposed, and it is then usually rewound in the cassette, or in another portion of the cassette.

The cassette can then be removed from the camera, the cassette being light proof, and it then may be transferred to a laboratory for developing. Usually, the film must be removed from the cassette in substantially total darkness, in a darkroom, and transferred into some form of developing tank.

This procedure is prefectly acceptable for the great majority of photographic uses. However, in certain cases there may be no available access to a laboratory, and it may be desirable to produce developed film on the spot. There may be many situations in which this is desirable. For example, intelligence or security type film applications for collecting military intelligence, may find it especially useful to provide for immediate on the spot developing of an exposed piece of film.

Similarly, in many industrial applications, or in applications where for example inspections of a remote piece of equipment such as a pipe line or the like is carried out photographically, it may be desirable to provide for immediate on the spot developing of an exposed length of film.

These are only a few of many uses to which this type of requirement may be found to be especially useful. Clearly however there may be many other situations such as news photography sporting photography, and others which may also find such requirements especially advantageous.

One particular example where this proceedure is advantageous is in the field of geological explorations. Drill holes are usually drilled through ore bodies to determine the extent and orientation of a particular ore body. These drill holes may be many thousands of feed in length, and the drill bit itself may wander quite substantially from its true course. It is therefore essential to have an accurate plot of the exact path of the drill hole along its length so that the geological information collected from the drill hole may be correctly interpreted.

A great variety of instruments for logging the path or deviation of the bore hole has been proposed. However, one particularly advantageous instrument and method is disclosed in co-pending application Ser. No. 693,110 entitled "Bore Hole Probe" filed June 4, 1976, now U.S. Pat. No. 4,047,306.

In this system, a length of photographic film contained within the bore hole probe or logging instrument is exposed one frame at a time at for example twenty-five or fifty foot intervals down the bore hole. The deviation of a spot of light from the center of the film frame will give an accurate indication of the deviation of the path of the bore hole.

Such investigations are usually carried out many hundreds or thousands of miles from civilization, and in severe climatic conditions. Seldom is there any opportunity to arrange for photographic dark-room and laboratory facilities. However, it is highly desirable that the information collected from such exposed photographic film may be studied, at the drill site itself. Accordingly, the provision of a facility for developing the exposed photographic film, without the need for darkroom facilities, in this type of situation is especially advantageous.

BRIEF SUMMARY OF THE INVENTION

The invention therefore seeks to provide a film storage and developing cassette comprising a closed elongated flattened box-like structure having top and bottom panels, side walls and end walls defining a generally closed light proof enclosure, and film storage compartment means within said box-like structure, having generally rounded walls therearound, for storing a coiled length of photographic film, and feed passage means communicating between said storage compartment and the exterior of said box-like structure, for the passage of said film therealong, and film development chamber means within said box-like structure, alongside said film storage compartment means, and return passageway means for feeding of said film back into said box-like structure, said return passageway means communicating with said development chamber means, and normally closed port means adapted to be opened after exposure of said film, for introduction of developer chemicals into said development chamber.

More particularly, it is an objective of the invention to provide a cassette having the foregoing advantages in which the development chamber means incorporates film guide means for guiding the edges of said film, and arranging said film in noncontiguous relation, so that any particular portion of film is out of contact with any other portion of film within said compartment, whereby to ensure free access of said chemicals thereto.

More particularly, it is an objective of the invention to provide a cassette having the foregoing advantages in which the chemical access port is located in registration with the film storage compartment means, and including connection port means extending between said film storage compartment means and said developer chamber means, whereby to permit free flow of fluid therebetween, while restricting passage of light from said access port to said developer chamber means.

More particularly, it is an objective of the invention to provide a cassette having the foregoing advantages in which one of said top panel and said bottom panel is removable whereby to give access to the interior of said box-like structure for introduction of film and removal of developed film therefrom.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

IN THE DRAWINGS

DESCRIPTION OF A SPECIFIC EMBODIMENT

Figure 1:
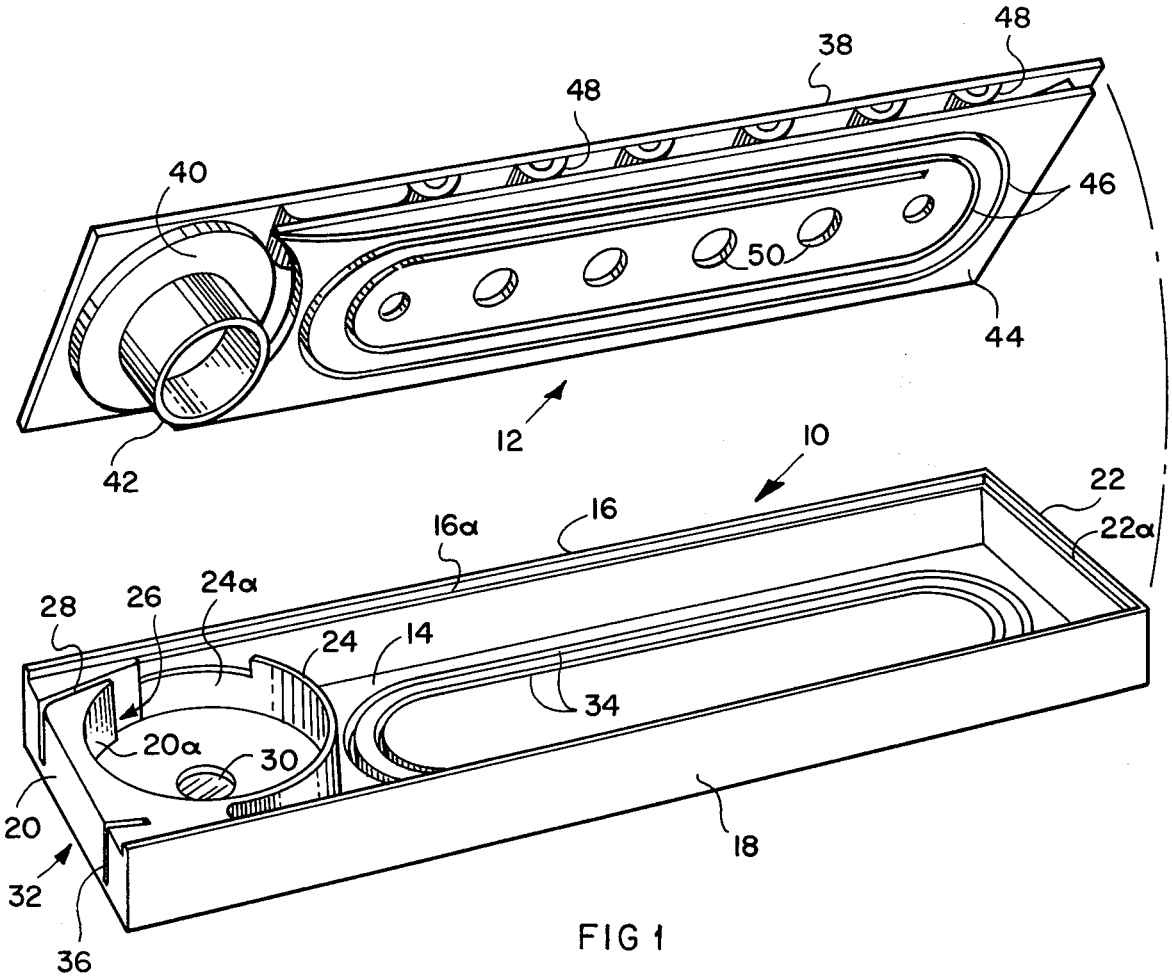
FIG. 1 is an exploded perspective illustration of the cassette according to the invention.
Figure 2:
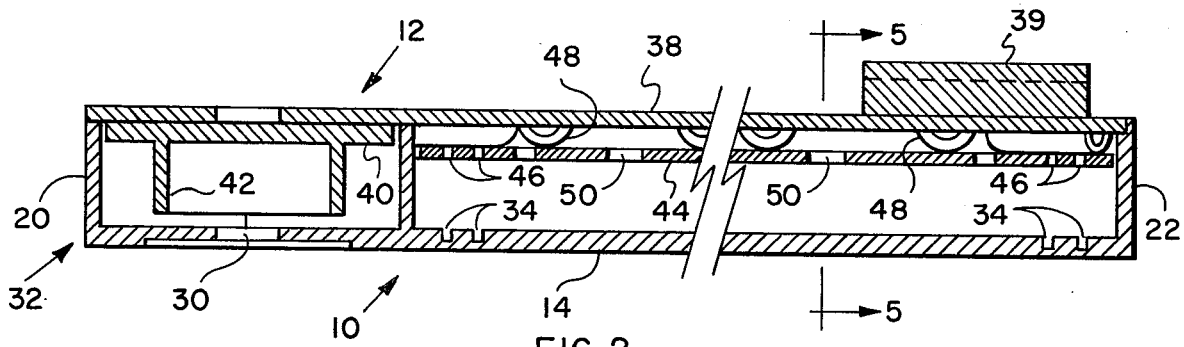
FIG. 2 is a section along the line 2—2 of FIG. 1, with the top panel in position.
Figure 3:
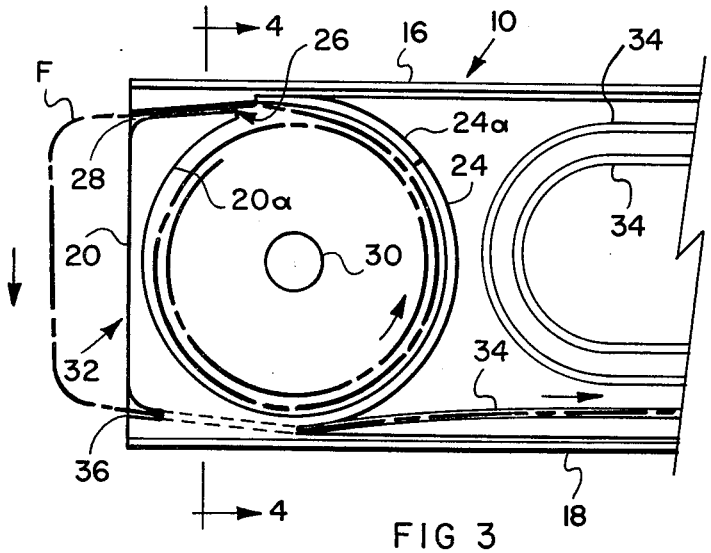
FIG. 3 is a top plan view with the top removed.
Figure 4:
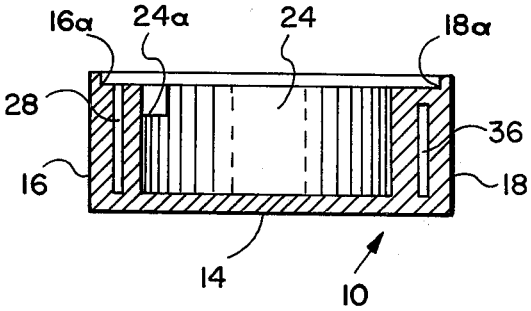
FIG. 4 is a section along the line 4—4 of FIG. 3.
Figure 5:
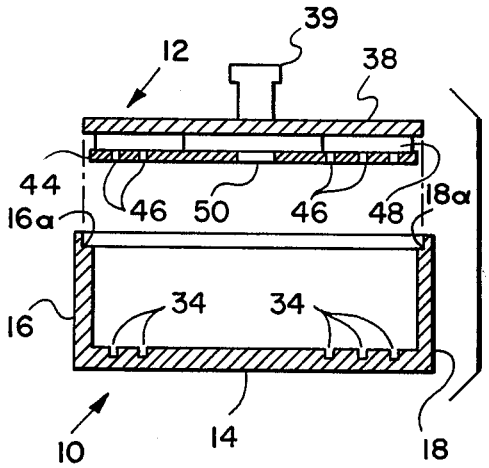
FIG. 5 is a section along the line 5—5 of FIG. 2.

Referring now to FIG. 1, it will be seen that this preferred embodiment of the invention comprises a generally rectangular box-like lower portion 10, and a rectangular shaped lid portion 12. As shown, the lid portion 12 is removed from the box portion 10 to reveal the interior construction. It will of course be appreciated however that this form of construction is purely exemplary. Other construction arrangements could be suitable in some purposes. In use, for all practical purposes the lid portion 12 is sealed in position over the open side of the box portion 10 sealing and closing the same against the entry of light, or against the escape of fluid, except through those apertures specifically provided, to be described below.

The lid 12 is not intended to be removable from the box portion 10, and in fact would normally be sealed closed in the factory. Preferably, it would be necessary to rupture an adhesive bond, or even to actually break the material forming the portions 10 or 12, to remove the contents after use. It will of course be appreciated that if desired a reusable form of box 10 and lid 12 could be provided in which case the lid 12 could be so arranged so as to make a good tight snap fit in the box 10.

Preferably, the box 10 and lid 12 will be formed of suitable thermoplastic materials, as being the most economical for the purpose, although the invention does not rule out the use of metals suitable for the purpose and being non-reactive with the developer chemicals employed in the processing of film.

Dealing first of all with the lower box portion 10, it will be seen to comprise a generally flat rectangular bottom wall panel 14, upstanding side walls 16 and 18, and end walls 20 and 22.

At one end of the box portion 10, a generally rounded film storage enclosure is provided by the inner surface 20*a* of the end wall portion 20, and the spiral wall 24 extending upwardly from the bottom panel 14, which together forms a rounded spiral shaped enclosure, defining a film storage space for storage of a coil of unexposed photographic film. Typically the photographic film will be for example of the so-called "Super" 8 mm. size although the cassette can equally well be adapted to the use of other sizes of film as may be desired for any particular purpose.

At one side of the spiral wall 24, an exit opening 26 is provided, by a continuation portion 24*a* in the wall 24. The exit opening 26 continues in the form of a slot 28, through the end wall portion 20 of the box portion 10, to permit feeding of the film from the cassette into a suitable camera (not shown).

An access opening 30 is provided in the bottom panel 14 more or less centrally of the wall portions 20*a* and 24*a* being normally closed by any suitable closure means 31. The closure means 31 may be for example an integrally moulded portion of the bottom panel 14, provided with a predetermined region of weakness so that it may be broken open. Alternatively, it may simply be a piece of adhesive tape or the like glued over the opening 30, within well 32.

The wall portion 24*a* of the wall 24 is seen to be of reduced height in relation to the wall 24. The wall portion 24*a* thus provides an access opening for passage of chemicals deposited within the opening 30, but otherwise acting as a light trap to prevent access of light.

The remainder of the box portion 10 will be seen to comprise a generally rectangular shaped open chamber, in which the exposed film is then developed and fixed. For this purpose it is necessary that the exposed film be held in a predetermined arrangement with the lengths or coils of film separated from one another by at least about one-eight of an inch. Within reason, the greater the separation between the coils of film, the better. The purpose of this is to insure that free flow of developer chemicals takes place around the entire length of the film simultaneously so as to insure even overall development of the film at the same time.

For this purpose, a guide slot 34 is cut in the bottom panel 14. The guide slot 34 will be seen to be of essentially a continuous nature in the form of an elongated spiral track.

Access to the track 34 is given by way of the return slot 36 formed in the end wall 20, and forming a passageway through the wall 20, which links and connects directly with the outermost portion of the guide slot 34. In this way, film passing through the passageway 36 will pass directly into the slot 34, and feed therearound continuously.

The lid portion 12 will be seen to comprise a top panel 38, having at one end a raised essentially rounded boss portion 40, shaped and adapted to fit snugly within the upper edges of the wall 20*a* and 24. A central generally cylindrical hub portion 42 extends downwardly from the boss 40, and is intended to fit within the interior of a coil of unexposed photographic film (not shown) which will be lying within the walls 20*a* and 24. It will of course be understood that such a coil of photographic film will have a tendency to spring apart and uncoil. It will thus tend to expand to its greatest diameter, until restrained by the walls 20*a* and 24, and the hub 42 will thus readily fit within the interior of such a coil. As the coil of film is slowly unwound, the hub 42 will assist in preventing it binding.

A guide plate 44 is provided, spaced inwardly from the top panel 38, and will have reduced dimensions in relation thereto so that it fits within the walls 16, 18 and 22 of the bottom portion 10. The guide panel 44 is provided with a continuous guide slot or track 46 which follows the same pattern as the guide slot or track 34 in the bottom panel 14.

The exposed film will thus be engaged along both its edges by means of the tracks 34 and 36, respectively, so as to insure that it cannot become uncoiled or disarranged in the developing process.

The guide panel 44 is attached to the top panel 38 by means of spaced apart hollow ribs 48, and the panel 44 is further provided with central openings 50. The panel 44 is thus spaced a distance below the top panel 38, and in this way chemicals can flow easily between the two panels 38 and 44 and back through the openings 50 so as to ensure a full and thorough circulation.

Clearly, many modifications can be made without departing from the scope of the invention. Thus for example instead of the film feeding out of one end 20 of the cassette, it could equally well be from one side say through the side wall 16 or 18. In this way, it might readily be adapted for use with wider film such as 35 mm. film and could be adapted for use with more conventional types of cameras, simply providing a film pack or cassette which would attach directly to the outside of the back of the camera. Similarly, the exit of the film from the storage portion of the cassette could take place at one end of the cassette, and the re-entry opening could be arranged at the other end of the cassette so that it for example film could enter at one end of a camera and exit at the other end.

In use, it will of course be appreciated that the top panel 12 will be closed down in position over the open side of the lower box portion 10. Typically, a suitable sealant will be used around the joint so as to exclude light and prevent the escape of fluid. Such a sealant may be for example in the form of an adhesive, lacquer or the like. Alternatively, if the top panel 12 is intended to be removable and replaceable, then it will be necessary to insure that it makes a good light tight and liquid tight seal.

In either case, the unexposed coil of film will be stored within the generally rounded chamber defined by the walls 20*a* and 24. The lead portion of the film will extend out through the slot 26 and 28. Such a lead portion of the film will then be introduced into the feed portion of a suitable camera (not shown) and will be lead around and back into the slot 36.

After operation of the camera for the appropriate number of frames, all of the film will have passed out of the film storage compartment, and will then be stored in the development chamber portion of the cassette, the film having run along the tracks 34 and 46, being gripped at its upper and lower edges so that it is held and arranged in spaced apart coils or lengths.

The closure 31 is then removed from the opening 30, and suitable developer chemicals are introduced into the opening 30. Typically, such developer chemicals will come pre-packaged in single dosage form so that a bottle or package may simply be ripped open and poured in and then thrown away.

The opening 30 may then be held closed with the thumb for example. The cassette is tipped so as to cause the chemicals to flow through opening 24*a* into the space between top panel 38 and guide plate 44 and flow through openings 50.

The chemicals can then flow freely around the film and the cassette is shaken for a predetermined length of time after which the developer chemicals will be drained off through the opening 30.

Suitable fixing chemicals will then be introduced and shaken in the same way and drained off.

The cassette may then be either broken open or the top portion 12 may be lifted off, and the developed film may be removed.

It will be understood that suitable light traps well known in the art may be incorporated in the slots 26 and 28, and 36. Such slots may also be sealed over with adhesive tape or wrapping materials where desired, or for example during use of the chemicals.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A film storage and developing cassette for storing raw unexposed photographic film, and for permitting the same to be exposed and subsequently developed therein, said cassette comprising;

an integral housing structure having film storage means, and developer chamber means therein;

film passageway means for passage of said film from said film storage means for exposure thereof and subsequently to be returned to said developer chamber means;

film guide means in said developer chamber for guiding said film entering said chamber along a predetermined path whereby to arrange said film in lengths, spaced apart from one another;

liquid circulation passageway means in said chamber for permitting liquid therein to circulate between respective said lengths of film in said chamber:

normally closed access port means, for introducing developer chemicals into said film storage means, and, opening means between said film storage means and said developer chamber for passage of said chemicals therein.

2. A film storage and developing cassette as claimed in claim 1 wherein said film storage means comprises generally annular wall means located adjacent one end of said integral one piece housing structure, and a film exit opening in said wall means communicating with said film passageway means, whereby film may be stored in coil form within said wall means, and may be removed therefrom through said exit opening to the exterior of said housing for exposure.

3. A film storage and developing cassette as claimed in claim 2 wherein said film passageway means includes an entry opening located in the end of said housing means adjacent said annular wall structure, and extends alongside said wall structure whereby said exposed film may re-enter said housing through said entry opening to one side of said annular wall means.

4. A film storage and developing cassette as claimed in claim 1 wherein said housing comprises a plurality of walls forming a generally rectangular shaped housing structure, and wherein said film guide means include a continuous spiral trackway formed in one wall of said housing, defining a film guide path, with spaces between adjacent portions of said trackway, whereby to arrange said film in a continuous spiral loop form with portions of said spiral out of contact with other portions thereof.

5. A film storage and developing cassette as claimed in claim 1 wherein said housing comprises a plurality of walls forming a generally rectangular shaped housing structure, and wherein said film guide means include a guide panel located to one side of said developer chamber in said housing, and spaced from an adjacent wall thereof, and including a continuous spiral film guide passageway formed therein, defining a film path wherein all portions of said film forming a spiral therein will be out of contact with other portions of said film.

6. A film storage and developing cassette as claimed in claim 5 including support means supporting and locating said panel with said developer chamber in said predetermined spaced apart relation from said wall of said housing, and including opening means extending around said panel whereby to permit free flow of developer chemicals around said panel and between said panel and said wall of said housing, to ensure full and free circulation thereof around all portions of said looped film in said film guide path.

7. A film storage and developing cassette as claimed in claim 2 wherein said normally closed access port means is located in a portion of said housing in registration with said annular wall means, whereby said chemical will first pass through said access port means into the space enclosed by said annular wall means, and including liquid passageway means in said annular wall means whereby to permit flow of said developer chemicals from said annular wall means through into said developer chamber means, said annular wall means thereby providing a light trap to prevent inadvertent exposure of said exposed film to light when filling said cassette with chemicals.

* * * * *